United States Patent [19]

Coe

[11] 4,194,293

[45] Mar. 25, 1980

[54] LETTERING TRIANGLE

[76] Inventor: Stanley S. Coe, 3515 Glenwood Ave., Raleigh, N.C. 27612

[21] Appl. No.: 28,207

[22] Filed: Apr. 9, 1979

[51] Int. Cl.[2] ..... B43L 13/02

[52] U.S. Cl. ..... 33/448; 33/174 B

[58] Field of Search ..... 33/104, 108, 109, 110, 33/174 B, 174 G

[56] References Cited

U.S. PATENT DOCUMENTS

| | | | |
|---|---|---|---|
| 2,016,985 | 10/1935 | Carlson | 33/110 |
| 2,430,230 | 11/1947 | Kuhl | 33/174 B |
| 2,702,944 | 3/1955 | Lane et al. | 33/174 B X |
| 3,602,999 | 9/1971 | Villiger | 33/108 X |

*Primary Examiner*—Harry N. Haroian

*Attorney, Agent, or Firm*—B. B. Olive

[57] ABSTRACT

A molded, transparent draftsman's triangle provides an adjustable lettering guide for rapid freehand lettering.

8 Claims, 7 Drawing Figures

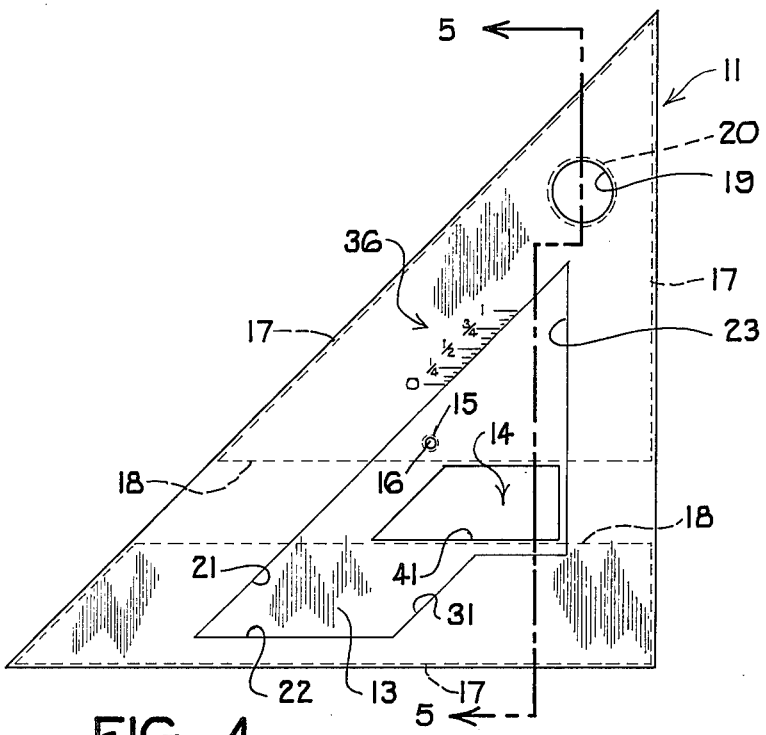
FIG. 4
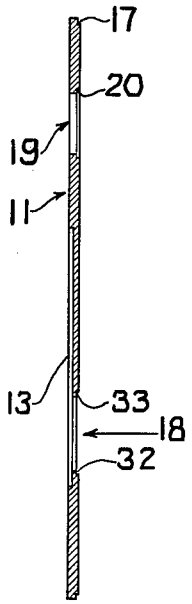
FIG. 5
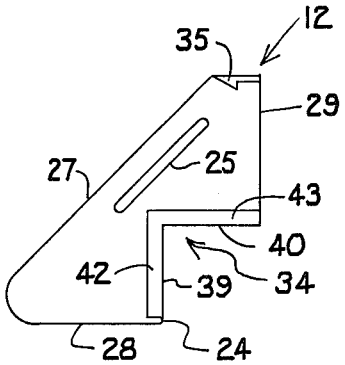
FIG. 6
FIG. 7

LETTERING TRIANGLE

BACKGROUND OF THE INVENTION

1. Field of the Invention

The draftsman's triangle of the present invention relates to drafting instruments and particularly to combination instruments for drawing angled lines and for providing guide means for freehand lettering.

2. Description of the Prior Art

Various forms of lettering guides, lettering templates, and the like, are available for use by draftsmen. Adjustable triangles and protractors and fixed-angle triangles with various combinations of corner angles are also available. Also, there are many versions of triangles which have holes permanently arranged therein and which offer a means for drawing lettering guidelines for various heights of letters.

U.S. Pat. No. 2,513,404 is illustrative of a triangle modified to provide adjustable means for lining or crosshatching with equally-spaced lines.

Taking all of the prior art of which applicant is aware into account, there is no lettering device available which provides adjustable vertical and horizontal guide edges for rapid freehand lettering and which does not require drawing guidelines. The provision of such a lettering device thus becomes the object of the present invention.

SUMMARY OF THE INVENTION

The lettering triangle of the invention as disclosed in the present embodiment comprises a thin, transparent plate member in the nature of a draftsman's right triangle but with various openings and recesses formed therein to receive a lettering guide member which is adjustably mounted and slides on the plate member. Various index markings are provided for aligning the lettering guide member with respect to the plate member. By adjusting and fixing the lettering guide member in a selected position on the plate member, the height of a vertical guide edge as well as the space between two horizontal guide edges can be selected according to the desired height of freehand lettering to be made. The overall result is to provide a much improved lettering triangle which allows very rapid freehand lettering to be accomplished without requiring guidelines with the lettering being applied through an opening defined by the vertical guide edge and the two horizontal guide edges.

In the specific embodiment disclosed, the height of the lettering is adjustable from a maximum of one inch to a minimum of one-sixteenth inch by one-sixteenth inch intervals. It is, of course, contemplated that smaller increments or a greater range of height could be used within the scope of the invention.

DESCRIPTION OF THE DRAWINGS

FIG. 4 is a plan view of the transparent plate member.

FIG. 5 is a section view taken substantially along line 5—5 of FIG. 4.

FIG. 6 is a plan view of the lettering guide member.

FIG. 7 is a right side elevation view of the guide member of FIG. 6.

DESCRIPTION OF THE PREFERRED EMBODIMENT

Figure 1:
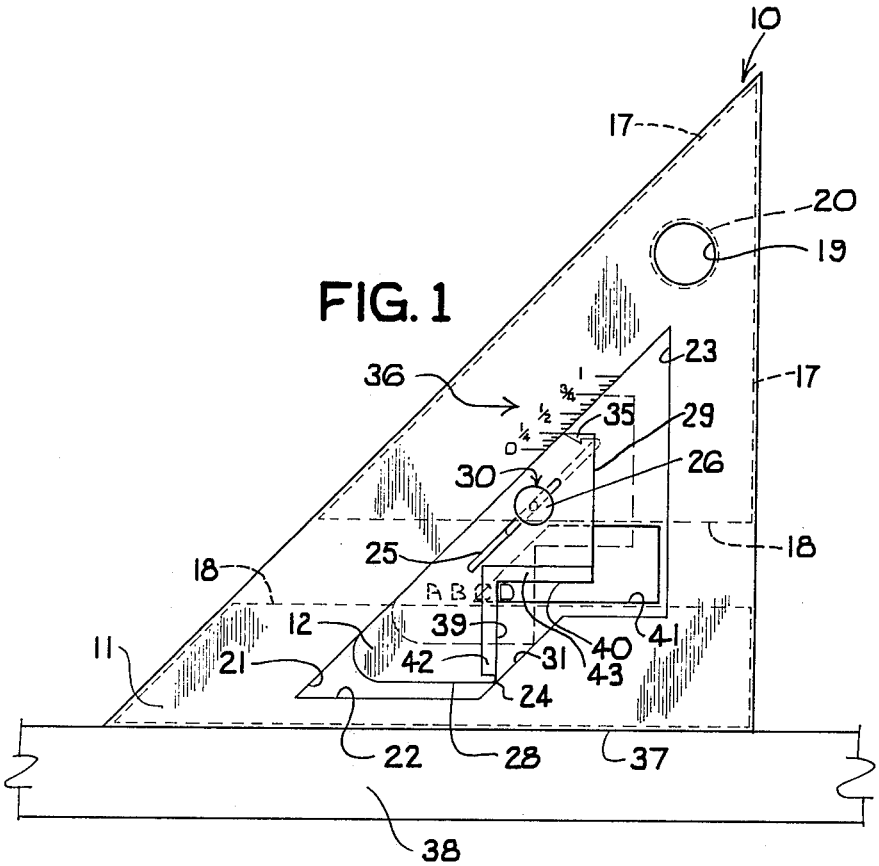
FIG. 1 is a plan view of a draftsman's lettering triangle according to the invention and illustrating the device in use with a standard straight edge and adjusted for one-quarter inch high lettering.

Referring first to FIG. 1, there is illustrated a draftsman's lettering triangle according to the invention and designated by the numeral 10. Lettering triangle 10 is composed of a plate member 11 comprising a thin, transparent sheet illustrated as being in the form of a right triangle, a lettering guide member 12 comprising a thin, transparent sheet which adjustably slides on plate member 11 and a knob assembly 30 which provides means for adjustably securing plate member 11 and for conveniently lifting triangle 10 in use. Guide member 12 slides parallel to the hypotenuse.

As best seen in FIG. 4, plate member 11 is molded with a shallow recessed area 13 in which the guide member 12 is slidably received. A portion of the recessed area 13 is removed which allows access to the medium, e.g., drawing paper, or the like, on which the lettering is being applied. A hole 15 is located in recessed area 13 preferably at or near the center of gravity of lettering triangle 10. A vertical threaded post 16 is secured in hole 15 and receives an internally threaded knob 26 which enables guide member 12 to be tightened in a fixed position within recessed area 13 as it slides along a defined path.

Lettering guide member 12, like plate member 11, is molded of a thin, transparent sheet material, as best seen in FIG. 6.

Guide member 12 is formed with a slot 25 which receives the previously-mentioned post 16 and allows for member 12 to slide back and forth within recessed area 13 of plate member 11 and while residing flush with the top surface of plate member 11. It may also be noticed that the edge 27 of plate member 12 rides against the edge 21 of recessed area 13 during back and forth travel of guide member 12 on plate member 11. Also, during this sliding motion, the corner 24 of guide member 12 rides on edge 31 of plate member 11. Downward travel of guide member 12 in recessed area 13 is limited by edge 28 coming into contact with edge 22 of recessed area 13. Upward travel of guide member 12 in recessed area 13 is limited by edge 29 coming into contact with edge 23 of recessed area 13. Guide member 12 is also formed with an open right angle notch 34 providing a vertical lettering guide edge 39 and a horizontal guide edge 40 which operate in conjunction with horizontal guide edge 41 of plate member 11 as later explained.

Figure 2:
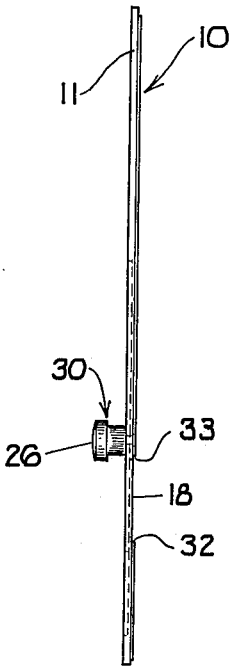
FIG. 2 is a right side elevation view of the lettering triangle.
Figure 3:
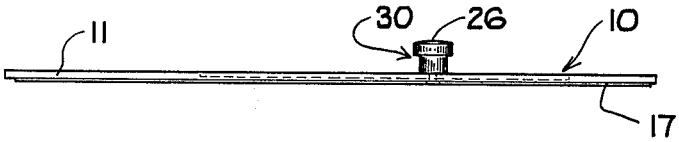
FIG. 3 is a side elevation view of the lettering triangle of FIG. 1 looking in the direction of the base edge of FIG. 1.

Along the outer bottom edge of plate member 11 there is provided a recessed ledge 17 which extends completely around the periphery of plate member 11. A recessed slot 18 is formed in the bottom surface of plate member 11 and extends completely across such back surface as best illustrated in FIGS. 4 and 5. Recessed ledges 32, 33 are formed on the outer edges of slot 18 as seen in FIGS. 2 and 5. A circular opening 19 is also provided in plate member 11 and has a inwardly tapered back edge 20. Opening 19 provides a useful guide for drawing arcs for dimensioning or labeling angles, arcs, and the like. Also, tapered edge 20 is useful when ink is being used. The outer straight edges of plate member 11 may be employed in a conventional fashion and the mentioned ledges 17, 32 and 33 facilitate use of ink so that freshly applied ink does not run under the triangle or smear as the triangle is slid along the drawing board surface.

A pointer 35 is hot-stamped, printed or otherwise defined on the top surface of guide member 12 and is aligned with the height lettering desired as indicated by the letter size indicators 36 which are also hot stamped, printed or otherwise defined on the top surface of plate member 11. While illustrated in specific locations in FIG. 1, it will be appreciated that the pointer 35 and letter size indicators 36 could be located in any suitable position enabling the relative location of guide member 12 with respect to plate member 11 to be adjustably fixed according to the height of lettering desired.

In use, the desired letter size is set by loosening knob 26 and sliding lettering guide member 12 on post 16 by means of slot 25 until pointer 35 is in alignment with the desired letter size indicator 36 which in the example of FIG. 1 is illustrated as being one-quarter inch. Knob 26 is then tightened after which lettering triangle 10 is placed on the drawing surface so that the bottom edge 37 of plate member 11 rests against a horizontal guide edge such as illustrated by straight edge 38. Triangle 10 may now be slid back and forth on straight edge 38 and the appropriate freehand lettering, as illustrated in FIG. 1, may be formed.

It will be noticed that edge 39 of guide member 12 provides a vertical guide edge whose length can be adjusted and which facilitates forming the vertical legs of the letters. Also to be noticed is that horizontal edge 40 of guide member 12 provides a horizontal guide edge for forming the upper horizontal legs of the letters and which can be adjustably spaced from a lower fixed horizontal guide edge 41 formed on plate member 11. Lower fixed guide edge 41 thus provides a horizontal guide edge for forming the lower horizontal legs of the letters. It would be anticipated that other portions of the letters would be rapidly formed in freehand style by the user but without requiring the use of guidelines. The previously mentioned recessed slot 18 allows for use of inking equipment and for sliding of triangle 10 on straight edge 38 without smearing of the ink. The recessed right angled top surfaces 42, 43 have been found especially useful in using the "Rapidiograph" type inking pens. Also, as previously mentioned, the recessed ledges 17 along the outer edges of plate member 11, the tapered edge 20 of opening 19 and the tapered edges 32,33 of slot 18 also facilitate use of inking of straight lines, arcs, hatching, and the like. The location of the knob assembly 30 provides a convenient means for picking up and placing triangle 10 since it is located at the center of gravity and it keeps the user's fingers from having to contact any of the top surfaces of members 11 and 12.

While it is desired that the plate member 11 and guide member 12 be formed of a lightweight, thin, transparent, plastic sheet material as the preferred construction, it is contemplated that other lightweight, thin, opaque, sheet materials, such as sheet aluminum, or the like, could be employed where it is not deemed necessary to see the material on which the lettering is being applied. It is also contemplated that where a guide for freehand lettering is to be the principal or only use of the device, that the plate member 11 could be shaped so as to have a straight bottom edge such as edge 37 but otherwise be shaped in some form other than in the shape of a right triangle, as illustrated.

While primarily intended for freehand lettering of letters, the device of the invention may also be found useful in freehand drawing of numbers, symbols, cross hatching and the term "lettering" as employed herein is intended to encompass all such applications of the invention.

What is claimed is:

1. An adjustable lettering device, comprising:

(a) a thin flat plate member having a straight base side for slidably engaging a straightedge, or the like, during lettering and above said base side and inwardly of the boundaries of said plate member above said base side a defined flat slide surface formed on the top surface of said plate member, said slide surface having an opening for lettering located within the boundaries thereof and bounded by a lower lettering guide edge parallel to said base side;

(b) a thin flat guide member adapted to reside within the boundaries of said slide surface and slide thereon along a defined path above said opening, said guide member being formed in a lower right corner portion thereof with an open right angle notch formed by intersecting horizontal and vertical lettering guide edges parallel and perpendicular respectively to said base edge and adapted for adjustable positioning over said opening as said guide member is slid along said path;

(c) adjustable means for securing said guide member on said plate member in a selected position with respect to said opening whereby the vertical spacing between said plate member opening lower lettering guide edge and said guide member horizontal lettering guide edge and the length of said guide member vertical lettering guide edge can be regulated according to the size lettering desired; and (d) mating measuring indicia formed on said plate and guide members enabling said guide member to be indexed on said plate member by matching respective indicia on said members according to the size lettering desired.

2. A lettering device as claimed in claim 1 wherein said flat slide surface is formed as a recessed flat side surface in the top surface of said plate member and said guide member is shaped to reside within the boundaries of said slide surface with the upper surface of said guide member residing flush with the top surface of said plate member.

3. A lettering device as claimed in claim 1 wherein said plate member is formed in the nature of a right triangle.

4. A lettering device as claimed in claim 1 wherein said guide member is provided with a guide slot oriented for the direction of travel of said guide member along said defined path and said adjustable means for securing said guide means on said plate member comprises a threaded post secured in a central position on said plate member and extending through said guide member guide slot and having a threaded knob mounted thereon adapted to be loosened and tightened for positioning said guide member on said plate member.

5. A lettering device as claimed in claim 1 wherein said measuring indicia includes a linear scale formed on the top surface of said plate member and a pointer formed on the top surface of said guide member adapted to be aligned with a selected point on the linear scale to determine the height of lettering.

6. A lettering device as claimed in claim 1 wherein said plate and guide members are formed from thin transparent plastic plate material 7. A lettering device as claimed in claim 1 including a recess of uniform width extending horizontally across the back of said plate member and through which said opening passes, the edges of said back recess being sloped in a manner facilitating smearless lettering with ink as said device is moved laterally during the course of use.

8. An adjustable draftsman's lettering triangle, said lettering triangle comprising:

(a) a thin flat transparent plate member having sides formed as a right triangle, a recessed right triangle shaped flat slide surface formed in the top surface of said plate member inwardly of the sides thereof and having an opening for applying lettering through said slide surface, said opening being bounded by a lower horizontal lettering guide edge parallel to the base side of said plate member, said plate member further including a recess of uniform width on the back surface thereof and oriented parallel to the base side of said plate member and containing said opening spaced inwardly from the edges of said recess;

(b) a thin flat transparent lettering guide member shaped to reside within the boundaries of said slide surface and slide thereon along a defined path above said opening with the outer surface of said guide member residing flush with the outer surface of said plate member, said guide member being formed in a lower right corner portion thereof with an open right angle notch formed by intersecting horizontal and vertical lettering guide edges parallel and perpendicular respectively to the base side of said plate member, said guide member further including an elongated slot with the axis thereof oriented in correspondence with said defined path and parallel to the hypotenuse side of said plate member;

(c) a threaded post member secured centrally of said plate member and extending outwardly from and perpendicular to the top surface of said plate member, said post member being adapted to be received within said guide member slot for guiding said guide member during adjustable positioning thereof along said path and having a threaded knob for securing said guide member in a selected position with respect to said opening whereby the vertical spacing between said plate member opening guide edge and said guide member horizontal guide edge and the length of said guide member vertical lettering guide edge can be regulated according to the size lettering desired; and (d) mating measuring indicia formed on said plate and guide members including a linear scale formed on said plate member and a pointer formed on said guide member enabling said guide member to be indexed on said plate member by matching respective indicia on said members according to the size lettering desired.

* * * * *